US009573030B2

(12) United States Patent
Clark

(10) Patent No.: US 9,573,030 B2
(45) Date of Patent: Feb. 21, 2017

(54) GOLFING TEE

(71) Applicant: Dean Clark, Sherman Oaks, CA (US)

(72) Inventor: Dean Clark, Sherman Oaks, CA (US)

( * ) Notice: Subject to any disclaimer, the term of this patent is extended or adjusted under 35 U.S.C. 154(b) by 0 days.

(21) Appl. No.: 14/793,955

(22) Filed: Jul. 8, 2015

(65) Prior Publication Data

US 2016/0206935 A1 Jul. 21, 2016

Related U.S. Application Data

(60) Provisional application No. 62/104,683, filed on Jan. 16, 2015.

(51) Int. Cl.
*A63B 57/10* (2015.01)

(52) U.S. Cl.
CPC ..... *A63B 57/10* (2015.10)

(58) Field of Classification Search
CPC ..... A63B 57/10–57/19
USPC ..... D21/717, 719
See application file for complete search history.

(56) References Cited

U.S. PATENT DOCUMENTS

D31,878 S * 11/1899 Sewall ..... D21/717
648,956 A * 5/1900 Herrick ..... A63B 57/10 473/387
654,666 A * 7/1900 Newton ..... A63B 57/10 473/394
1,564,212 A * 12/1925 Decker ..... A63B 57/10 473/390
1,636,655 A * 7/1927 Young ..... A63B 57/10 473/387
D75,984 S * 8/1928 Reich ..... D21/717
1,696,136 A * 12/1928 Coburn ..... A63B 57/12 473/387
2,661,213 A * 12/1953 Barnard ..... A63B 57/10 473/394
2,805,071 A * 9/1957 Kaplan ..... A63B 57/10 473/398
3,554,543 A * 1/1971 DiLaura ..... A63B 57/10 273/DIG. 8
3,697,082 A 10/1972 Di Laura et al.
5,033,747 A * 7/1991 Young ..... A63B 57/10 473/279
5,242,161 A * 9/1993 Wilkirson ..... A63B 57/10 473/386
5,492,323 A * 2/1996 Lee ..... A63B 57/10 473/278
5,679,081 A * 10/1997 Santilli ..... A63B 57/10 473/391
6,200,233 B1 * 3/2001 Moody ..... A63B 57/10 473/387
2009/0264225 A1 * 10/2009 Lee ..... A63B 57/10 473/396

OTHER PUBLICATIONS http://www.golfsmith.com/product/30097536/ztech-tundra-tees.

* cited by examiner

*Primary Examiner* — Steven Wong

(57) ABSTRACT

A golf tee is disclosed that provides stability and promotes less spin on a struck golf ball. The tee may be beneficial for use on mats at a driving range. The golf ball may be elevated from the ground surface to help avoid the club head from contacting the ground thereby avoiding injury to the golfer and damage to the club.

6 Claims, 3 Drawing Sheets

GOLFING TEE

CROSS-REFERENCE TO RELATED APPLICATION

This application claims benefit under 35 U.S.C. §119(e) of U.S. Provisional Application having Ser. No. 62/104,683 filed Jan. 16, 2015, which is hereby incorporated by reference herein in its entirety

FIELD

The subject disclosure relates to sporting goods, and more particularly, to a golfing tee.

BACKGROUND

Conventional golf tees are designed with a wide tee platform, which tapers down to a thinning shank that can pierce soil. They are typically fragile and many are destroyed by a swing coming in too steep and hitting down on the ball. While adequate for play on a course, conventional golf tees are inadequate for driving ranges that situate golfers on a hard surface. A driving range typically positions a golfer practicing his swing on a hard surface such as concrete and the golf ball is played off a mat. A conventional tee cannot pierce the hard underlying surface of the mat. Even if balanced on the mat, the conventional tee would be top heavy and the golfer would have difficulty maintaining the ball on the tee. The golfer may place the ball directly on the mat or may elevate the ball using an improvised object such as a bottle cap. Such approaches used at a driving range may be harmful to the golfer and the golf club. Hitting a ball off the mat or just elevated therefrom may result in the club striking the surface, jamming the golfer's arm, or damaging the club head.

As can be seen, there is a need for a device that can support a golf ball on hard surface environments with sufficient elevation and stability while holding the ball.

SUMMARY

In one aspect of the disclosure, a golf tee comprises a support platform configured to hold a golf ball. The support platform includes a first area dimension. A base portion includes a second area dimension greater than the first area dimension. The golf tee also includes a support projection projecting vertically from the base portion. The support platform is supported by the support projection and elevated from the base portion.

It is understood that other configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

DETAILED DESCRIPTION

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be apparent to those skilled in the art that the subject technology may be practiced without these specific details. Like or similar components are labeled with identical element numbers for ease of understanding.

In general, exemplary embodiments of the subject technology provide a golf tee that provides stability and traction for use on hard surfaces. Aspects of the subject technology may be beneficial for use on golfing mats or other surfaces where a tee cannot pierce the ground and/or the ball should be elevated and maintained in position before striking. For example, aspects of the golf tee disclosed may be beneficial for swinging an iron. The disclosed golf tee provides a minimal footprint so that contact with a club head is minimized yet the ball is raised from the ground. This may be helpful as a teaching aid or for use during practice since the low profile of the disclosed golf tee is virtually unseen from the golfer's perspective. The disclosed golf tee elevates a golf ball just above the underlying surface so that the trajectory of an iron is at or just above the ground. In a practice environment, a golfer may appreciate that his or her swing may be unaltered because of the low profile provided by the disclosed golf tee. The club face may impact the golf ball square to the ground minimizing contact, if any with the underlying surface.

Figure 1:
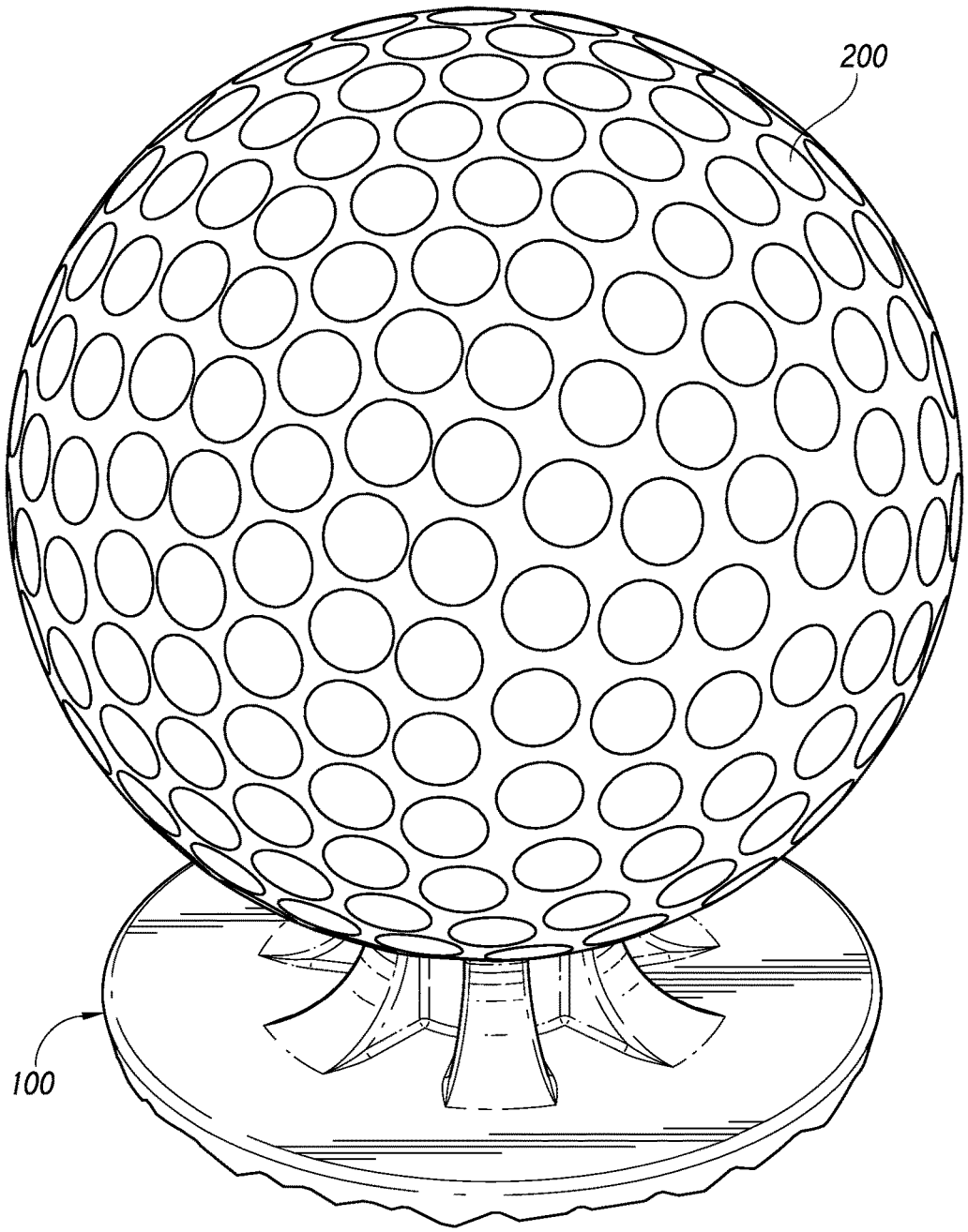
FIG. 1 is a perspective view of a golf tee holding a golf ball in accordance with an aspect of the subject technology.

Referring now to FIG. 1, a golf tee 100 is shown according to an exemplary embodiment of the subject technology. The golf tee 100 is shown in use holding a golf ball 200. As will be appreciated by aspects of the description below, the golf tee 100 provides stability. In addition, aspects of the golf tee 100 provide a ventilated tee head with less surface area, which may promote less spin on a struck golf ball 200 for increased distance and precision.

Figure 2:
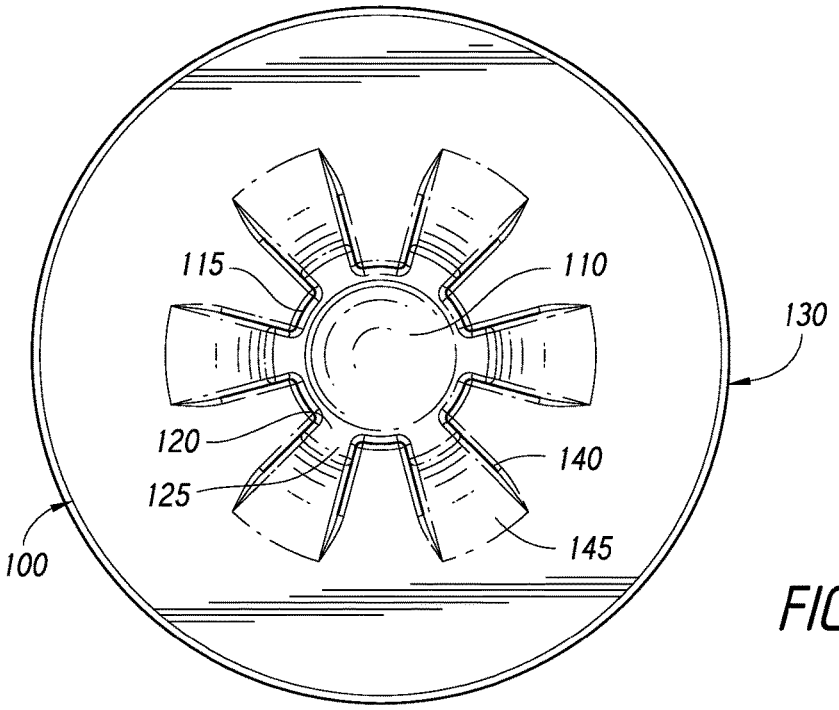
FIG. 2 is a top view of the golf tee of FIG. 1.
Figure 4:
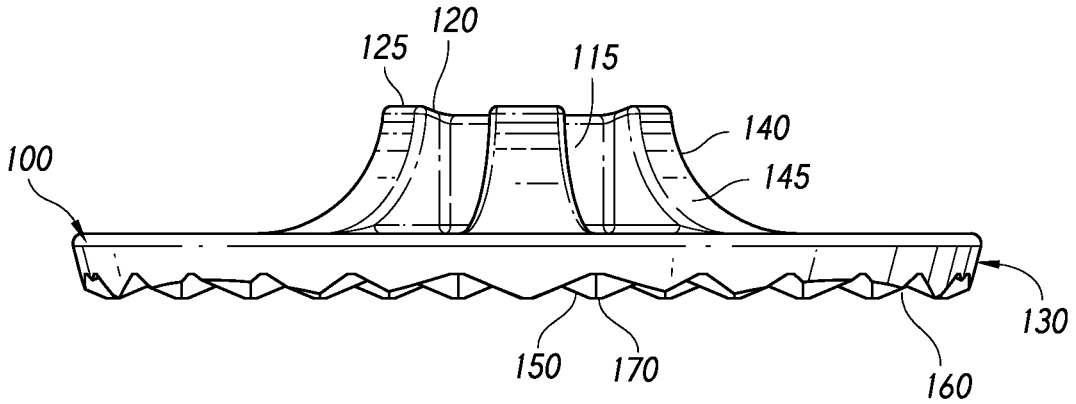
FIG. 4 a side view of the golf tee of FIG. 1.

Referring now to FIGS. 2 and 4, the golf tee 100 generally includes a support platform 110 and a base portion 130. In an exemplary embodiment the golf tee 100 may be made of for example, plastic, however other materials may be used. The support platform 110 and base portion 130 may be generally round however it will be understood that other shapes can be used effectively and without departing from the scope of the subject technology. The support platform 110 may be supported on a support projection 115 projecting vertically from the base portion 130 (with respect to gravity) so that the support platform 110 is elevated from the base portion 130. The support projection 115 may range between for example, 0.187 inches to approximately 4.0 inches. The support projection 115 may be for example, a column. The support platform 110 may have a first area dimension (such as a diameter) that is smaller than the area dimension (diameter) of the base portion 130. The support platform's first area dimension is large enough to hold the golf ball 200 (FIG. 1). In some embodiments, the support platform's first area dimension is smaller than the circumference of the golf ball 200. In some embodiments, the area of the support platform 110 is approximately the same size as a number of current commercial tee heads. The base portion 130 may be smaller than the golf ball 200 which may minimize the area of the golf tee 100 subject to contact with a club head. The golf ball 200 is held stably in place by virtue of the base portion 130 being larger than the support platform 110.

In an exemplary embodiment, one or more buttresses 140 may emerge from the top side of the base 130 and may surround the support column 115 and the periphery of the support platform 110. For sake of illustration, only a single buttress 140 and its features is called out. The exemplary embodiment shown includes six buttresses 140 however it will be understood that any number of buttresses 140 may be employed. Each buttress 140 may include a top edge 125, which may have a height from the base 130 that is higher than the height of the support platform 110. The buttresses 140 may have heights slightly higher than the support projection 115. In an exemplary embodiment, the height of the support projection 115 may be 0.240 inches from the base 130 and the height of the surrounding top edges 125 may be 0.250 inches, however as may be understood any height elevated from the base 130 may be used. The buttresses 140 may be spaced so that at their top edges 125, air channels are defined between the highest portions of adjacent buttresses 140 and the support platform 110 is ventilated. The spacing provided by ventilation channels which coupled with the smaller support platform 110 area may promote less spin on a struck ball for increased distance and precision. In some embodiments, the buttresses 140 may include a concave sloped surface 145 facing radially away from the support column 115. The buttresses 140 may also include a sloped concave surface 120, which may project downwardly from the top edge 125 of each buttress 140 to the support platform 110. As may be appreciated, the buttresses 140 may provide multiple advantages. For example, the combination of the sloped surfaces 120 and the height of top edges 125 above the support platform 110 surround the support platform 110 and help cradle the golf ball 200 (FIG. 1) to prevent it from falling off the golf tee 100. In addition, the buttresses 140 generally protect the golf tee 100 from errant swings that would otherwise damage support projection 115.

Figure 3:
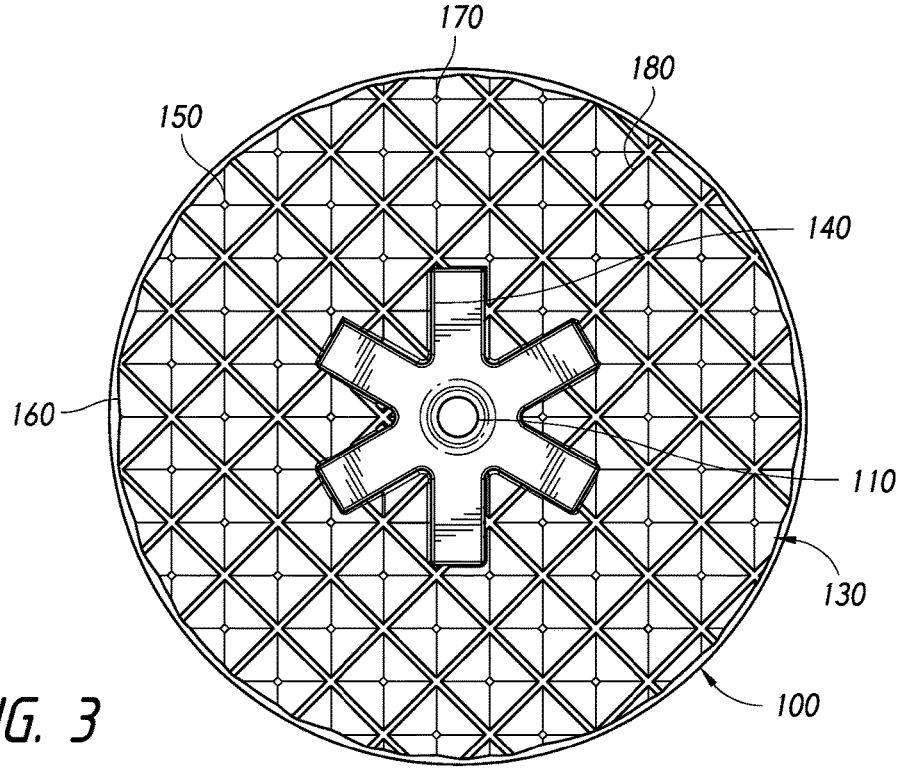
FIG. 3 is a bottom view of the golf tee of FIG. 1.

Referring now to FIGS. 3 and 4, the base portion 130 may include an underside 160 configured to provide traction with an underlying surface, for example a golf mat or real grass tee box. As shown in FIG. 3, the golf tee 100 may be injection molded or extruded from material, for example plastic into a one-piece body leaving a central opening in the underside 160 through which the interior surfaces of the support platform 110 and buttresses 140 may be visible. The base portion 130 may include grip projections 150 projecting from the underside 160. For sake of illustration only single instances of the grip projections 150 and their features are called out. The grip projections 150 may in some embodiments be inverted pyramids with apexes 170 that are disposed to contact an underlying surface. The grip projections 150 may be hard plastic or rubber depending on the expected surface to be played on. Channels 180 are defined between adjacent grip projections 150. In embodiments using pyramidal projections 150, the channels 180 may be diverging. The golf tee 100 has stability since the base portion 130 is conducive to creating traction with a mat or other surface. The channels 180 create a larger surface area to adhere to underlying surfaces. The grip projections 150 may catch fabric loops rising from a mat or may cause friction. The benefits of the grip projections 150 and channels 180 may minimize lateral movement.

In general, it will be appreciated that the golf tee 100 is suited for use with, for example, irons or hybrid golf clubs in golfing environments that may be particularly prone to damage when striking an underlying surface. The support platform 110 elevates the golf ball 200 sufficiently above the mat (or other surface) and provides a larger profile so that an iron or hybrid club is swung biased toward the top of the tee 100 rather than just above or at the ground.

Those of skill in the art would appreciate that various components and blocks may be arranged differently (e.g., arranged in a different order, or partitioned in a different way) all without departing from the scope of the subject technology.

The previous description is provided to enable any person skilled in the art to practice the various aspects described herein. The previous description provides various examples of the subject technology, and the subject technology is not limited to these examples. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the invention.

Terms such as "top," "bottom," "front," "rear," "above," "below" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference. Similarly, an item disposed above another item may be located above or below the other item along a vertical, horizontal or diagonal direction; and an item disposed below another item may be located below or above the other item along a vertical, horizontal or diagonal direction.

A phrase such as an "aspect" does not imply that such aspect is essential to the subject technology or that such aspect applies to all configurations of the subject technology. A disclosure relating to an aspect may apply to all configurations, or one or more configurations. An aspect may provide one or more examples. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples. A phrase such an embodiment may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples. A phrase such a configuration may refer to one or more configurations and vice versa.

The word "exemplary" is used herein to mean "serving as an example or illustration." Any aspect or design described herein as "exemplary" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. A golf tee, comprising:

a support platform configured to hold a golf ball, the support platform including a first area dimension;

a base portion including a second area dimension greater than the first area dimension;

a support projection projecting vertically from the base portion, wherein the support platform is supported by the support projection and elevated from the base portion;

a plurality of buttresses completely surrounding the support projection, the plurality of buttresses projecting radially outward from an outer surface of the support projection and extending from a top side of the base portion to a height taller than the support platform; and top edges of the plurality of buttresses, wherein the plurality of buttresses are spaced from each other defining air channels between the top edges providing ventilation into the support platform.

2. The golf tee of claim 1, further comprising an underside of the base portion configured to provide traction with an underlying surface.

3. The golf tee of claim 1, further comprising a plurality of grip projections projecting from an underside of the base portion.

4. The golf tee of claim 3, wherein the grip projections are pyramidal.

5. The golf tee of claim 3, wherein the grip projections are configured to grasp a fabric surface.

6. The golf tee of claim 1, further comprising a concave surface surrounding the support platform.

* * * * *